United States Patent [19]

Pöhacker

[11] Patent Number: 4,964,170

[45] Date of Patent: Oct. 16, 1990

[54] HEARING AID

[75] Inventor: Friedrich Pöhacker, Vienna, Austria

[73] Assignee: Viennatone Gesellschaft m.b.H., Vienna, Austria

[21] Appl. No.: 324,298

[22] Filed: Mar. 15, 1989

[30] Foreign Application Priority Data

Mar. 22, 1988 [AT] Austria ..... 763/88

[51] Int. Cl.[5] ..... H04R 25/02

[52] U.S. Cl. ..... 381/69; 381/68; 381/68.7; 381/69.2

[58] Field of Search ..... 381/69, 69.1, 69.2, 381/68, 68.7

[56] References Cited

U.S. PATENT DOCUMENTS

| | | | |
|---|---|---|---|
| 2,794,085 | 5/1957 | Angelis | 381/69.2 |
| 3,102,172 | 8/1963 | Cohen | 381/69.2 |

FOREIGN PATENT DOCUMENTS

| | | | |
|---|---|---|---|
| 2751755 | 6/1978 | Fed. Rep. of Germany . | |
| 8319075 | 7/1983 | Fed. Rep. of Germany . | |
| 3742877 | 6/1989 | Fed. Rep. of Germany | 381/68 |
| 0042500 | 4/1981 | Japan | 381/68.5 |

OTHER PUBLICATIONS

Telex Communications, Inc. Advertisement, "Telex 344 with Audio Input Power Plus", Oct. 1982, from *Hearing Instruments*, vol. 33, No. 10, p. 11.

*Primary Examiner*—Jin F. Ng
*Assistant Examiner*—M. Nelson McGeary, III
*Attorney, Agent, or Firm*—Kurt Kelman

[57] ABSTRACT

A hearing aid particularly useful for placement behind an ear of a hard-of hearing person comprises a multi-part housing containing electrical hearing aid components, detachable fastening elements for holding the parts of the housing together, and an audio input connection including at least two detachable fastening elements.

8 Claims, 1 Drawing Sheet

HEARING AID

BACKGROUND OF THE INVENTION (1) Field of the Invention

The present invention relates to a hearing aid particularly useful for placement behind an ear of a hard-of hearing person, which comprises a multi-part housing containing electrical hearing aid components, such as a microphone, an audio signal amplifier, an audio signal receiver, a battery and the like, detachable fastening elements for holding the parts of the housing together, and an audio input connection to one of the components.

The audio input connection is an electrical contact arrangement which feeds an electrical audio signal directly, i.e. galvanically, to an amplifier in the housing. Such an audio input is used frequently in schools for hard-of-hearing persons in connection with "multiple hearing devices", or in connection with FM- or infrared radiation transmitters. However, individual head-of-hearing persons may also profit from various auxiliary devices, such as hand-held microphones, TV-adapters, hand-carried cassette players, etc., which may be connected to the audio input.

Electrically, the audio input is an electrical contact device which enables the output cable of an external audio signal source to be connected to the hearing aid by means of a plug-and-pin combination or a pressure contact, for example.

Due to the notorious lack of space in modern behind-the-ear hearing aids, these electrical contact arrangements differ from one manufacturer to the other and frequently even from model to model of the same manufacturer. This has necessitated in hard-of-hearing schools, for example, an unbelievably high number of different cable connections.

(2) Description of the Prior Art

It has been proposed to solve this problem by providing a so-called audio shoe. This is a cup-like structure which is clamped to the lower part of the hearing aid and whose inside carries contact springs adapted to engage individual contact arrangements of the respective hearing aid while its outside defines two or three sockets for a standardized Euro audio plug. Such an audio shoe has been disclosed in German patent No. 2,751,755. Each type of hearing aid requires a specific audio shoe.

In view of the continuing efforts to miniaturize all hearing aids and their components, behind-the-ear hearing aids also are becoming ever smaller, and the most up-to-date constructions have ever less room for contact arrangements for an audio input connection. Therefore, many miniaturized hearing aids are on the market today which have no audio input of the described type and while they are particularly adapted for use by children, their usefulness is accordingly restricted. A possible solution has been proposed by German Utility Model No. 8,319,075, which discloses a plug-in arrangement for the audio input in the form of a "backpack" suspended from the hearing aid. However, this is not a very attractive solution because it increases the overall size of the hearing aid and the "backpack" remains in position even when no audio input is required.

SUMMARY OF THE INVENTION

It is the primary object of this invention to provide a hearing aid of the first-described type and which does not have the above-indicated disadvantages.

The above and other objects are accomplished in such a hearing aid according to the invention with an audio input connection which includes at least two of the detachable fastening elements holding the parts of the housing together.

The present invention thus uses two of the existing fastening elements, such as metallic screws, holding the two parts of the housing together to serve also as contacts for the audio input. This has the advantage of requiring neither a special housing nor any additional space for the contact arrangement. Furthermore, there are no structural parts increasing the size of the hearing aid when the audio shoe is removed.

BRIEF DESCRIPTION OF THE DRAWING

The above and other objects, advantages and features of the invention will become more apparent from the following detailed description of certain now preferred embodiments thereof, taken in conjunction with the somewhat diagrammatic drawing wherein.

DETAILED DESCRIPTION OF PREFERRED EMBODIMENTS

Figure 1:
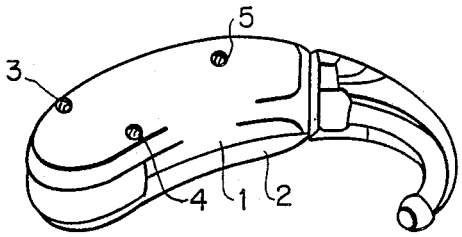
FIG. 1 is a perspective view of a behind-the-ear hearing aid which may incorporate the audio input connection of this invention.

Referring now to the drawing, FIG. 1 schematically illustrates a generally conventional behind-the-ear hearing aid comprising a two-part housing comprised of two halves 1, 2 held together by three fastening elements, such as screws, 3, 4, 5. According to the invention, screws 3 and 4 are used as electrical connections for the audio input.

Figure 2:
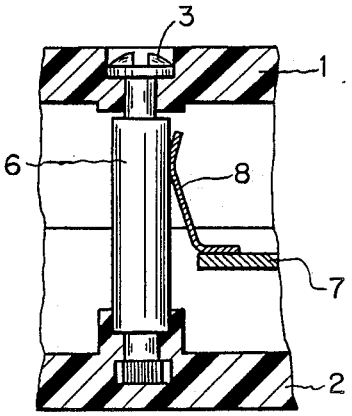
FIG. 2 is a fragmentary, enlarged section through the hearing aid housing in the range of one of the fastening elements holding the two housing parts together.

As shown in FIG. 2 in connection with screw 3 (which is the same arrangement as that for screw 4), metallic female bolt 6 has one end injection molded in lower housing part 2 while its opposite end has a threaded bore into which male screw 3 is threaded to hold upper housing part 1 on the lower housing part. As shown, metallic screw 3 has a conical head countersunk in housing part 1 to be out of contact with the skin of the hard-of-hearing person whereby undesirable electrical side-effects or stray noises are avoided when no audio shoe is used. The stem of male screw 3 passes through a bore in housing part 1 to enter the threaded bore in bolt 6.

Figure 3:
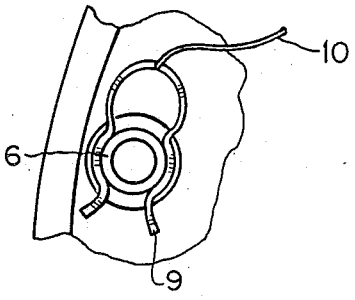
FIG. 3 is a fragmentary top view of the lower housing part, showing a two-pronged contact spring.

In the embodiments of FIGS. 2 and 3, the audio input connection comprises an electrical contact with bolt 6 so that the same must be electrically conductive to provide a connection between the metallic screw and a respective electrical hearing aid component in the housing. In the embodiment of FIG. 2, the electrical contact is made by pressure spring 8 establishing contact between amplifier plate 7, to which one end of the spring is soldered or rivetted, and bolt 6 against which the opposite end of the leaf spring is biased.

If there is no space for such a leaf spring, contact may be made by a two-prongued spring engaging the bolt, such as shown at 9 in FIG. 3. Such a hair pin spring may be snapped into engagement with bolt 6, and connection wire 10 has one end soldered to spring 9 while an opposite end is connected to the amplifier plate. It is usually not desirable to solder the connection wire directly to the bolt since the soldering heat may damage the housing which is usually made of synthetic resin. However, connection wire 10 may be welded to bolt 6 to provide a non-detachable connection.

If desired, female bolt 6 may consist of synthetic resin, in which case it may be injection molded in one piece with lower housing part 2. In this case, contact spring 8 or 9 must be in direct contact with metallic screw 3.

Figure 4:
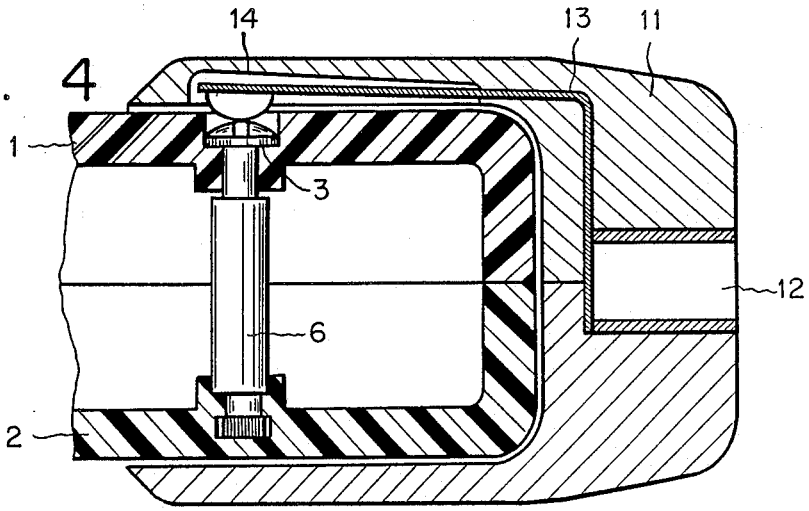
FIG. 4 is a fragmentary, enlarged section through the hearing aid housing in the range of one of the fastening elements holding the two housing parts together, showing an audio shoe placed on the hearing aid and another embodiment of the contact arrangement.

FIG. 4 shows audio shoe 11 placed on two-part housing 1, 2. The audio shoe defines sockets 12 for a standardized audio input plug and comprising contact spring 13 affixed thereto and having one end extending into the socket and an opposite end carrying contacts 14 engaging the metallic screws. Illustrated contact 14 is hemispherical and forms a self-cleaning electrical contact with the conical head of screw 3. The countersunk recesses in housing part 1, in cooperation with hemispherical contacts 14, serve at the same time as snap-in rests retaining audio shoe 11 on the hearing aid housing.

If desired, a separate audio shoe retention may be provided. Also, while the hearing aid housing parts are usually held together by screws, other types of fastening elements may be used.

The electrical hearing aid components contained in the hearing aid housing have not been illustrated since they are altogether conventional and they have no bearing on the present invention. They may be arranged in any desired manner according to the particular type of hearing aid used, and include such components as a microphone, amplifier, audio signal receiver, battery, operating elements, etc.

What is claimed is:

1. A hearing aid particularly useful for placement behind an ear of a hard-of-hearing person, which comprises (a) a multi-part housing containing electric hearing aid components, (b) detachable fastening elements for mechanically holding the parts of the housing together, and (c) an audio input connection including at least two of said detachable fastening elements galvanically connected to an audio signal source.

2. The hearing aid of claim 1, wherein the detachable fastening elements of the connection are metallic screws extending through one of the mounting parts.

3. The hearing aid of claim 2, wherein the metallic screws are counter-sunk in the one housing part to be out of contact with the skin of the hard-of-hearing person.

4. The hearing aid of claim 1, wherein the connection further comprises a spring element making electrical contact with the detachable fastening elements.

5. The hearing aid of claim 4, wherein the spring element is a pressure spring engaging each detachable fastening element.

6. The hearing aid of claim 4, wherein the spring element is a two-prongued spring engaging each detachable fastening element.

7. A hearing aid particularly useful for placement behind an ear of a hard-of-hearing person, which comprises (a) a multi-part housing containing electrical hearing aid components, (b) metallic fastening screws extending through one of the housing parts for mechanically holding the parts of the housing together, (c) an audio shoe mounted on the housing and defining an audio input socket, and (d) an audio input connection including at least two of said screws, (1) the audio shoe comprising a contact spring having one end extending into the socket and an opposite end carrying contacts engaging the metallic screws and forming self-cleaning electrical contacts therewith.

8. The hearing aid of claim 7, wherein the metallic screws have conical heads and the contacts at the opposite contact spring ends are hemispherically shaped.

* * * * *